US007954200B2

(12) United States Patent
Leonatti et al.

(10) Patent No.: US 7,954,200 B2
(45) Date of Patent: Jun. 7, 2011

(54) CONSTANT HEAD DEVICE FOR A CLEANING MACHINE

(75) Inventors: John A. Leonatti, Uniontown, OH (US); Christel R. Richard, North Canton, OH (US)

(73) Assignee: The Hoover Company, North Canton, OH (US)

( * ) Notice: Subject to any disclaimer, the term of this patent is extended or adjusted under 35 U.S.C. 154(b) by 2174 days.

(21) Appl. No.: 10/396,860

(22) Filed: Mar. 25, 2003

(65) Prior Publication Data

US 2004/0187250 A1 Sep. 30, 2004

(51) Int. Cl.
*A47L 7/00* (2006.01)

(52) U.S. Cl. ..... 15/320; 15/321

(58) Field of Classification Search ..... 15/320, 15/321

See application file for complete search history.

(56) References Cited

U.S. PATENT DOCUMENTS

| | | | | | |
|---|---|---|---|---|---|
| 517,305 | A | | 3/1894 | Schlueter | |
| 1,278,764 | A | | 9/1918 | Seiler | |
| 2,857,084 | A | | 10/1958 | Harris | 222/481 |
| 3,237,346 | A | | 3/1966 | Watts | 47/1.7 |
| 3,262,146 | A | * | 7/1966 | Hays | 15/321 |
| 3,896,521 | A | * | 7/1975 | Parise | 15/321 |
| 4,327,459 | A | * | 5/1982 | Gilbert | 15/321 |
| 4,475,264 | A | * | 10/1984 | Schulz | 15/321 |
| 4,507,819 | A | * | 4/1985 | Martinec | 15/321 |
| 4,741,069 | A | * | 5/1988 | Helm et al. | 15/320 |
| 4,956,891 | A | | 9/1990 | Wulff | |
| 5,299,608 | A | * | 4/1994 | Bosyj | 15/320 |
| 5,311,638 | A | * | 5/1994 | Furcron et al. | 15/321 |
| 5,367,740 | A | * | 11/1994 | McCray | 15/320 |
| 5,411,716 | A | | 5/1995 | Thomas et al. | 422/264 |
| 5,500,977 | A | | 3/1996 | McAllise | |
| 5,983,442 | A | | 11/1999 | Louis et al. | |
| 6,647,585 | B1 | * | 11/2003 | Robinson | 15/322 |
| 6,658,692 | B2 | * | 12/2003 | Lenkiewicz et al. | 15/320 |
| 6,684,452 | B2 | * | 2/2004 | Lehman et al. | 15/320 |
| 6,735,812 | B2 | * | 5/2004 | Hekman et al. | 15/320 |
| 6,775,880 | B2 | * | 8/2004 | Kasper et al. | 15/321 |
| 6,789,290 | B2 | * | 9/2004 | Kent et al. | 15/322 |
| 2003/0014829 | A1 | * | 1/2003 | Wang | 15/320 |
| 2003/0051310 | A1 | | 3/2003 | Morgan et al. | |
| 2003/0217421 | A1 | | 11/2003 | Besel | |

FOREIGN PATENT DOCUMENTS

| | | |
|---|---|---|
| CA | 712875 | 7/1965 |
| GB | 1121225 | 7/1968 |
| GB | 2389304 | 10/2003 |

OTHER PUBLICATIONS

Page 4 from Owner's Manual for Bissell Little Green Machine (Model 1425-1) Copyrighted 2002).

Pages 7 & 19 from Owner's Manual For Singer Soilsport (Model W51500) received on Oct. 30, 1995.

* cited by examiner

*Primary Examiner* — Theresa T. Snider

(74) *Attorney, Agent, or Firm* — A. Burgess Lowe, Esq.; Brett A. Schenck, Esq.

(57) ABSTRACT

A cleaning apparatus for cleaning a surface in which cleaning solution is dispensed to the surface is provided. The cleaning apparatus includes a distributor for dispensing solution to the surface and a solution tank fluidly connected to the distributor for supplying a flow of solution to the distributor. The solution tank has a bottom portion and an upper portion. A constant head device is fluidly connected to the solution tank such that the flow of solution from the solution tank to the distributor is substantially constant independent of the level of solution in the solution tank.

19 Claims, 5 Drawing Sheets

CONSTANT HEAD DEVICE FOR A CLEANING MACHINE

BACKGROUND OF THE INVENTION

1. Field of the Invention

The present invention relates to a cleaning machine having a constant head device.

2. Background Information

It is known to have floor cleaning units that have a liquid distribution system for dispensing detergent to wash the floor and/or clean water to rinse the floor. Often when washing the floor, detergent from one supply tank is automatically mixed with clean water and then the mixed cleaning solution is distributed on the floor. It is desirable to maintain a constant mix ratio between the detergent and clean water, especially in a gravity flow system for its low cost benefits. However, as the level of the water and detergent lowers during the application of cleaning solution in a gravity flow system, the flow rates out of the tanks will also decline and at disproportional rates from each other. This is due to the different static heads caused by the different levels of water and detergent in their respective tanks. These variable flow rates produces a variable mixing ratio. One solution is to pump the fluids from their respective tanks at a pressure that is much higher than the static head, thus making the effect of the liquid level on flow rate insignificant. However, the pump is an added cost, consumes power, and is subject to failure.

Another problem is that if the fluid levels in the tanks are unequal, cross flow occurs through the mixing chamber in which the output lines of the tanks are fluidly connected thereto. This cross flow results in uncontrollable mixing of the two fluids. One solution is to provide check valves in the output lines of the water and detergent tanks. However, this adds costs and causes flow restrictions to the system.

Hence, it is an object the present invention to provide a cleaning machine having a solution tank in which the flow of cleaning solution is constant irrespective of the level of cleaning solution.

It is another object of the present invention to provide a cleaning machine with clean water and detergent tanks having a low cost and reliable automatic mixing system in which the mixing ratio of clean water and detergent is constant irrespective of the levels of clean water and detergent in their respective tanks.

SUMMARY OF THE INVENTION

The foregoing and other objects of the present invention will be readily apparent from the following description and the attached drawings. In one aspect of the invention, a cleaning apparatus for cleaning a surface in which cleaning solution is dispensed to the surface and substantially simultaneously extracted along with the dirt on the surface in a continuous operation is provided. The cleaning apparatus includes a distributor for dispensing solution to the surface and a solution tank fluidly connected to the distributor for supplying a flow of solution to the distributor. The solution tank has a bottom portion and an upper portion. A recovery tank is mounted to the cleaning apparatus. A suction nozzle, secured to the cleaning apparatus, is in fluid communication with the recovery tank for transporting air and liquid into the recovery tank. A tubular member is fluidly connected to the solution tank and extends down from the upper portion to a sufficient distance above the bottom portion such that the flow of solution from the tank to the distributor is substantially constant independent of the level of solution in the solution tank.

In another aspect of the invention, a cleaning apparatus for cleaning a surface in which cleaning solution is dispensed to the surface is provided. The cleaning apparatus includes a distributor for dispensing solution to the surface. A first solution tank is fluidly connected to the distributor for supplying a flow of a first solution to the distributor. The first solution tank has a bottom portion and an upper portion. A first tubular member is fluidly connected to the first solution tank and extends down from the upper portion to a sufficient distance above the bottom portion such that the flow of solution from the first solution tank to the distributor is substantially constant independent of the level of solution in the first solution tank. A second solution tank is fluidly connected to the distributor. The second solution tank has a bottom portion and an upper portion. A second tubular member is fluidly connected to the second solution tank and extends down from the upper portion to a sufficient distance above the bottom portion such that the flow of solution from the second tank to the distributor is substantially constant independent of the level of solution in the second solution tank.

In another aspect of the invention, a cleaning apparatus for cleaning a surface in which cleaning solution is dispensed to the surface and substantially simultaneously extracted along with the dirt on the surface in a continuous operation is provided. The cleaning apparatus includes a distributor for dispensing solution to the surface and a solution tank fluidly connected to the distributor for supplying a flow of solution to the distributor. A recovery tank is mounted to the cleaning apparatus. A suction nozzle, secured to the cleaning apparatus, is in fluid communication with the recovery tank for transporting air and liquid into the recovery tank. A tubular member is fluidly connected to the solution tank at its bottom portion. A fluid flow device is associated with the tubular member to maintain the flow of solution at a substantially constant rate independent of the level of solution in the solution tank.

BRIEF DESCRIPTION OF THE DRAWINGS

The invention will now be described, by way of example, with reference to the attached drawings, of which.

DETAILED DESCRIPTION OF THE INVENTION

Figure 1:
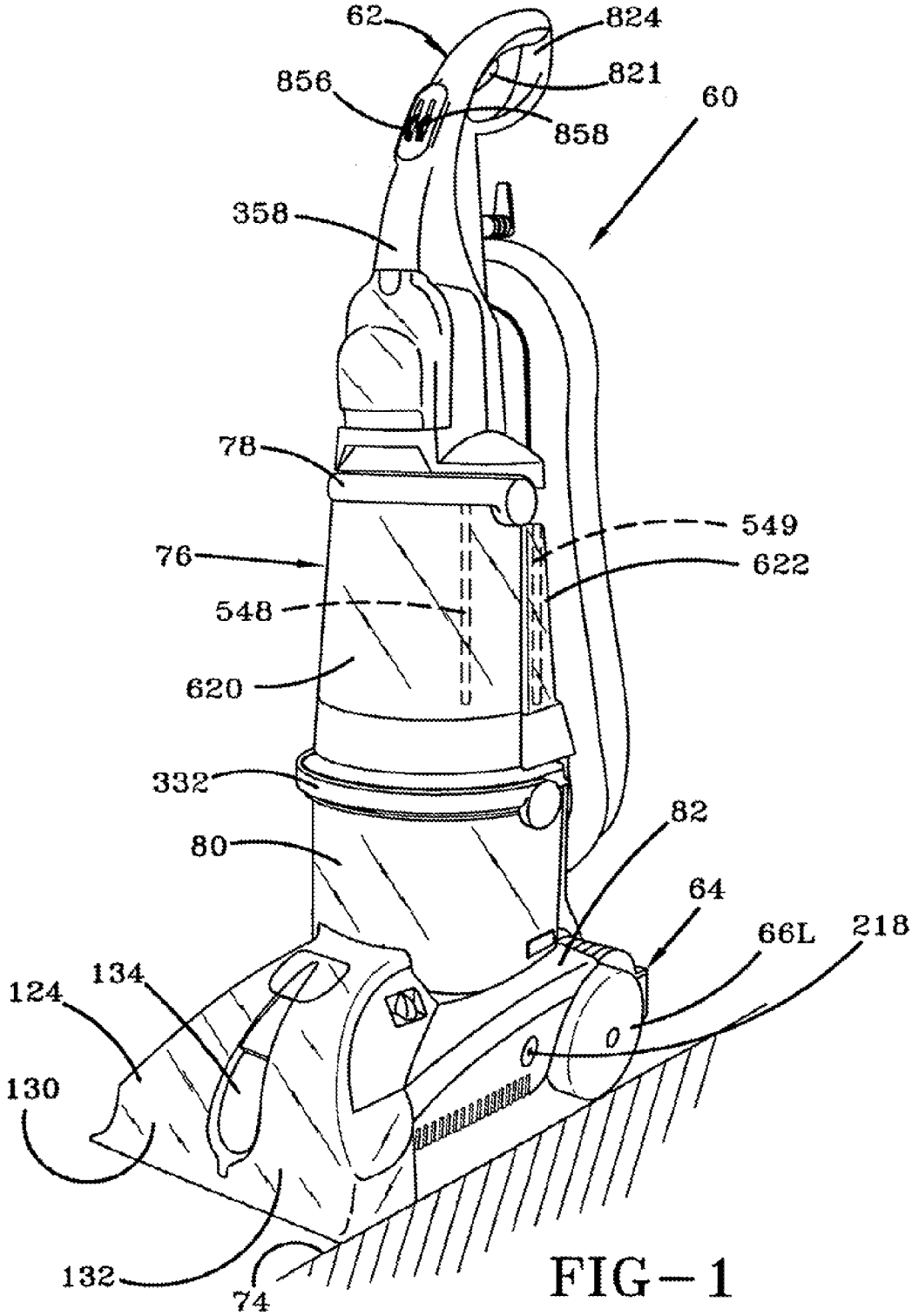
FIG. 1 is a perspective view of a carpet extractor embodying the present invention.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet. The base assembly 64 includes two laterally displaced wheels 66 (only the left wheel 66L being shown) rotatably attached thereto. A supply or solution tank assembly 76 is removably mounted to the handle portion 62 of the extractor 60. A combined air/water separator and recovery tank 80 with carrying handle 332 removably sets atop a motor/fan assembly of base assembly 64 and is surrounded by a hood portion 82. A floor suction nozzle assembly 124 is removably mounted to the hood portion 82 of the base assembly 64 and in fluid communication with the recovery tank 80 for transporting air and liquid into the recovery tank 80. The floor suction nozzle assembly 124 includes a front plate secured to a rear plate that in combination define dual side ducts 130, 132 separated by a tear drop shaped opening 134. Further details of the carpet extractor are disclosed in co pending published application No. 2003/0226230; the disclosure being incorporated herein by reference.

Figure 2:
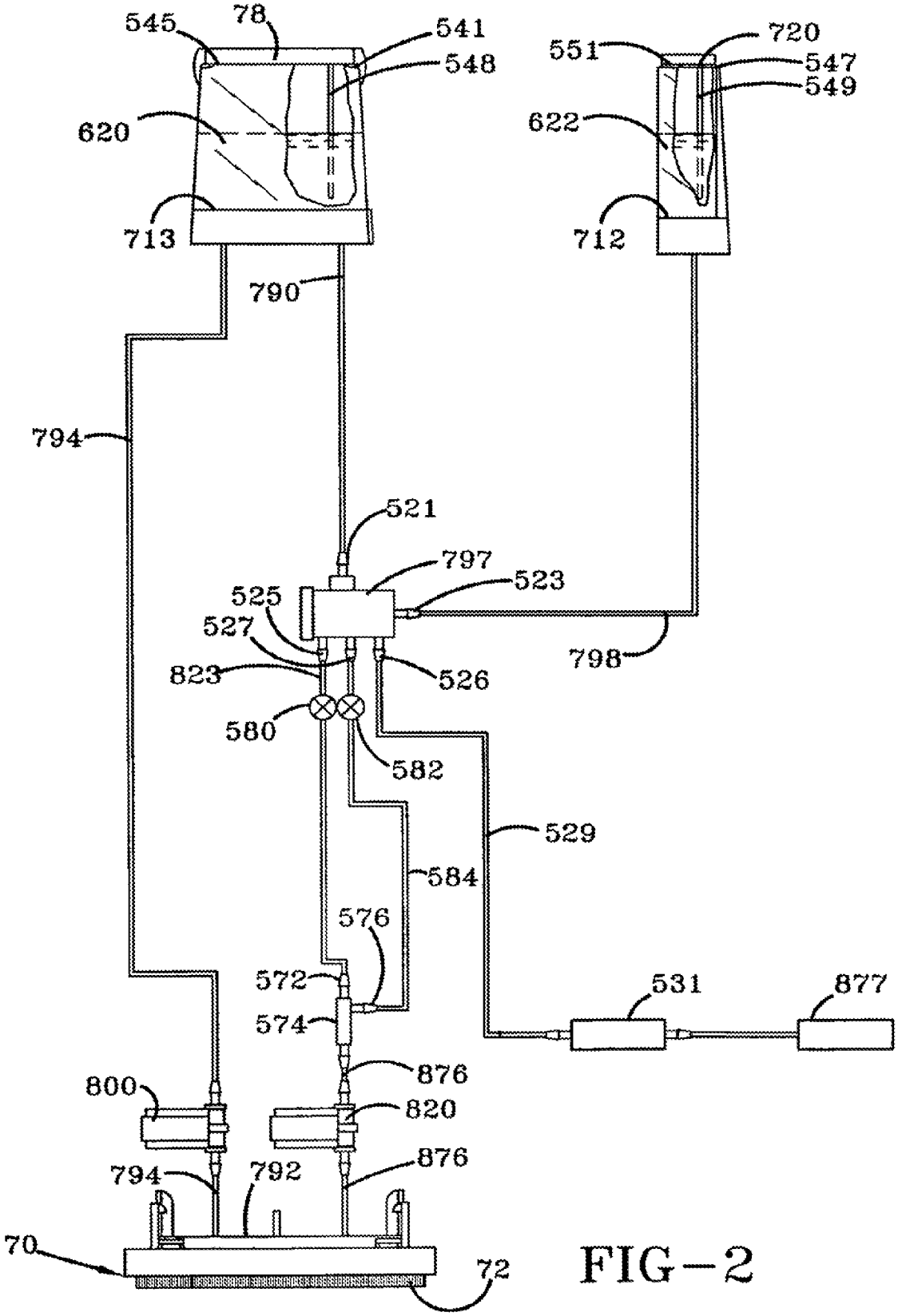
FIG. 2 is a schematic view of the fluid distribution system of the embodiment shown in FIG. 1 with portions broken away for illustrative purposes.

As depicted in FIG. 2, the base assembly 64 includes a brush assembly 70 having a plurality of rotating scrub brushes 72 for scrubbing the surface. A suitable brush assembly 70 is taught in U.S. Pat. No. 5,867,857, the disclosure which is incorporated herein by reference. Brush assembly 70 is operated by a suitable gear train (or other known means). A suitable air turbine driven gear train is taught in U.S. Pat. No. 5,443,362, the disclosure of which is incorporated by reference. Other brush assemblies could be used such as, for example, a horizontal brush roll or fixed brush assembly.

The supply tank assembly 76 comprises a clean water supply tank 620 and a detergent supply tank 622 adhesively mounted to the clean water supply tank 620 as depicted in FIG. 1. The supply tank assembly 76 includes a combination carrying handle and tank securement latch 78 providing a convenient means for carrying the tank and/or securing the tank to the extractor handle assembly 62.

Figure 3:
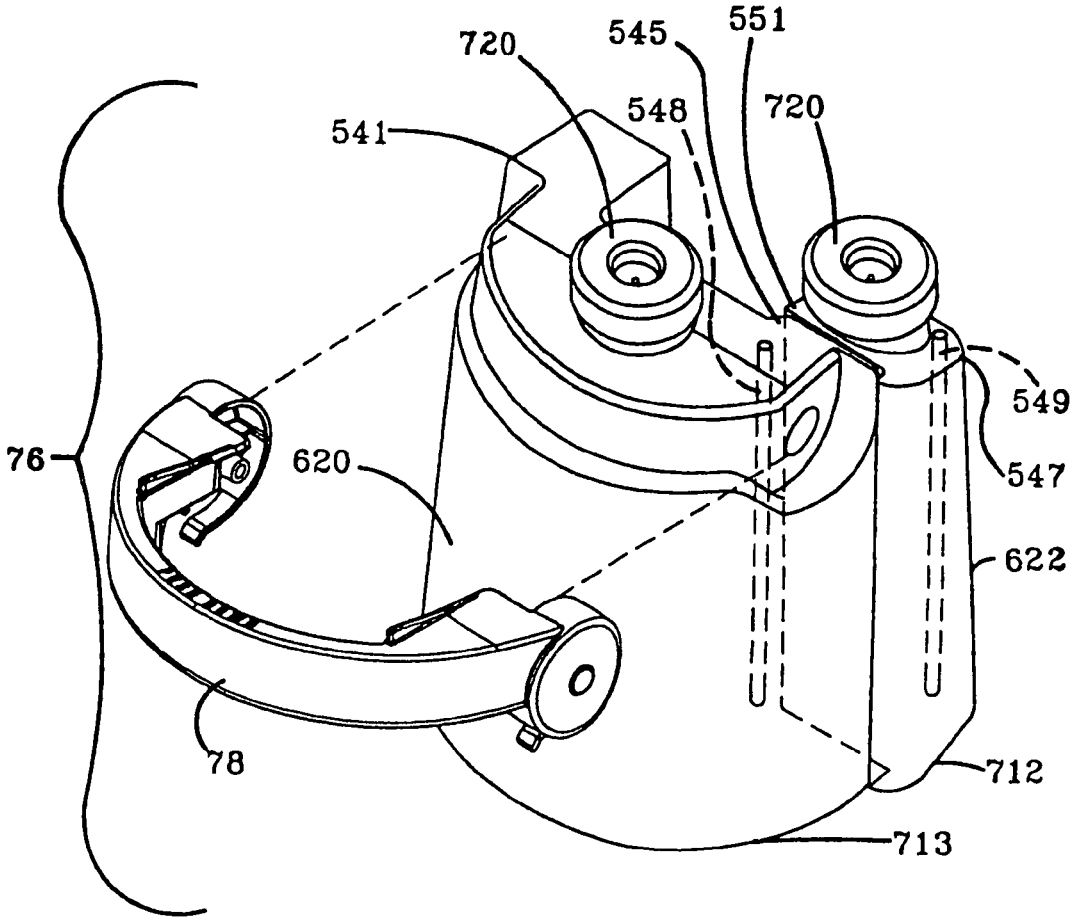
FIG. 3 is a top perspective view of the tank assembly of FIG. 1 with the tank carrying handle separated for illustrative purposes.

Referring to FIGS. 2 and 3, each of the tanks 620, 622 has a cap 720 covering a top opening for filling the corresponding clean water tank 620 or detergent tank 622 with liquid. The clean water tank 620 has a bottom wall 713 and an upper portion 541. A vent tube 548 with its upper end open to atmosphere is fluidly connected to the clean water tank 620 via the top wall 545 of the upper portion 541, and extends down to a sufficient distance above the bottom wall 713 such that the flow of solution from the clean water tank 620 to the distributor 792 is substantially constant independent of the level of solution in the clean water tank. Likewise, the detergent tank 622 also has a bottom wall 712 and an upper portion 547. A vent tube 549 is also fluidly connected to the detergent tank 622 via the top wall 551 of the upper portion 547 and extends down a sufficient distance above the bottom wall 713 such that the flow of solution from the detergent water tank 622 to the distributor 792 is substantially constant independent of the level of solution in the detergent tank 622.

In effect, this system operates as a constant head device such that fluid flowing from each of the tanks does so under constant head pressure, which corresponds to the height between the outlet of the clean water tank 620 or detergent tank 622 and the lower end of the corresponding clean water vent tube 548 or detergent vent tube 549. This system also prevents cross mixing of the two fluids in one of the tanks if the fluid levels are different. The vent tubes can be integrally formed with the tank or secured to the tank by any suitable way, such as, for example, by an adhesive. Alternatively, the vent tubes can extend through the sidewall of the upper portion of the clean water or detergent tank.

Figure 4:
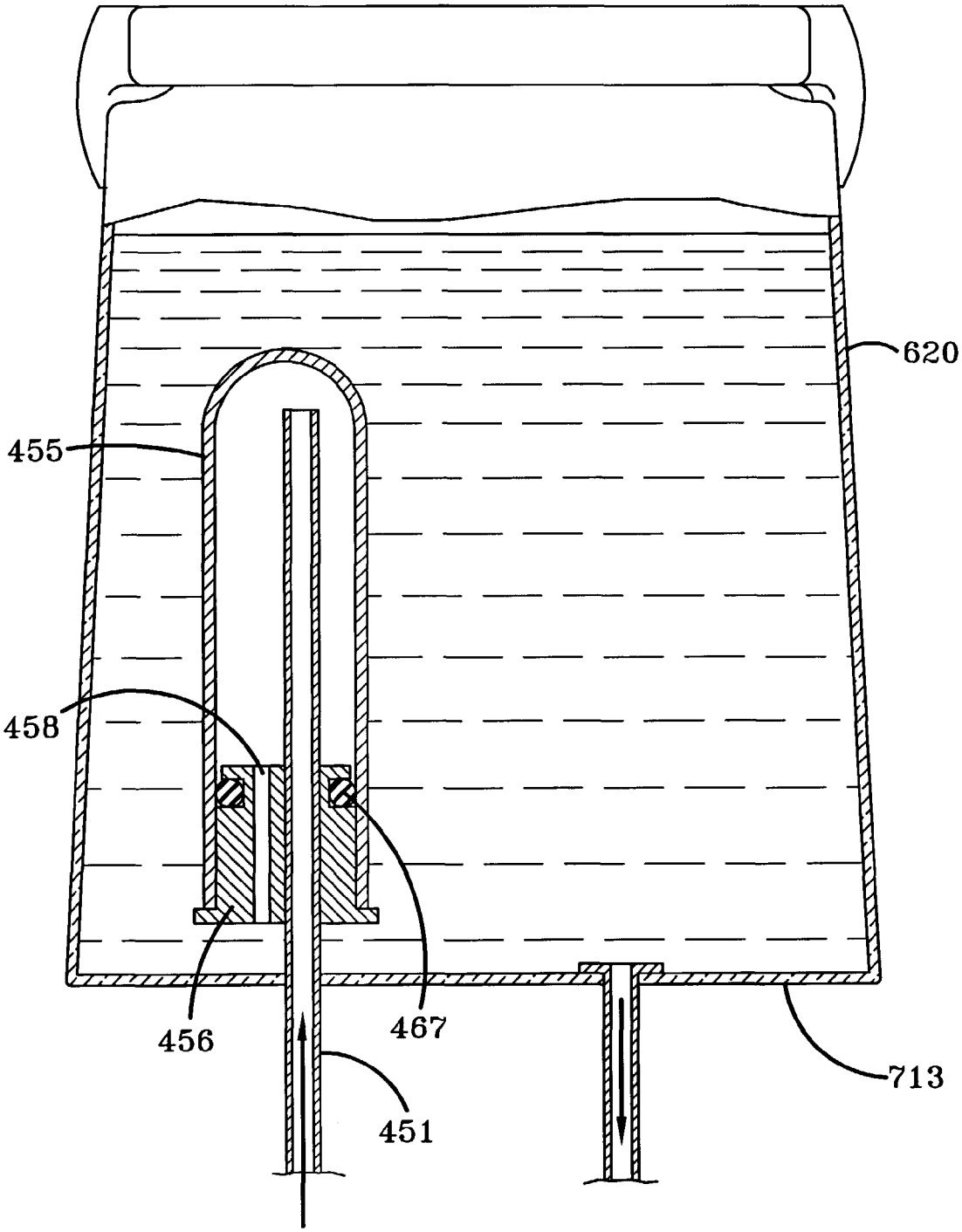
FIG. 4 is a vertical sectional view of the clean water tank of the carpet extractor of FIG. 1 showing another embodiment of the present invention.

Referring to FIG. 4, in another embodiment, a vent tube 451 is fluidly connected to the clean water tank 620. The vent tube 451 extends upwardly through the bottom wall 713 of the clean water tank 620. The lower end of the vent tube is opened to atmosphere. An umbrella like tube 455 with a diameter larger than that of the vent tube 451 covers the upper end of the vent tube 451. The upper end of the tube 455 is closed and the lower end is provided with a removable plug 456 and a sealing ring 467, which is positioned between the plug 456 and inner wall of the tube 455. A passageway 458 is formed in the plug and provides fluid communication between the interior of the tube 455 and the tank 620. The plug 456 and passageway 458 are located near the bottom 713 wall of the clean water tank 620. The tube 455 functions as an air reservoir with a large volume relative to the flow passage of the tube 451 and the passageway 458. The tube 451 extends near the upper end of the tube 455 at a point above the level of the passageway 458. The clean water tank 620 having this constant head device would be incorporated in the carpet extractor 60 of FIGS. 1 and 2. Also, this constant head device in the clean water tank 620 would also be used in the detergent tank 622.

As the liquid level lowers, air enters the tube 451 to maintain the pressure within the reservoir 455 at atmospheric pressure. For a given volume of water exiting the clean water tank 620, additional air is introduced into the clean water tank 620 from the air reservoir 455 through the passageway 458. This arrangement allows the effective pressure head acting to discharge the liquid through the outlet of the clean water tank 620 to be substantially constant regardless of the liquid level in the clean water tank 620. Thus, the liquid flow remains constant. It should be noted that the passageway 458 is of a relatively small flow area so that small bubbles are introduced rather than large bubbles, which causes more turbulence and thus causes undesirable variations in the pressure head.

Figure 5:
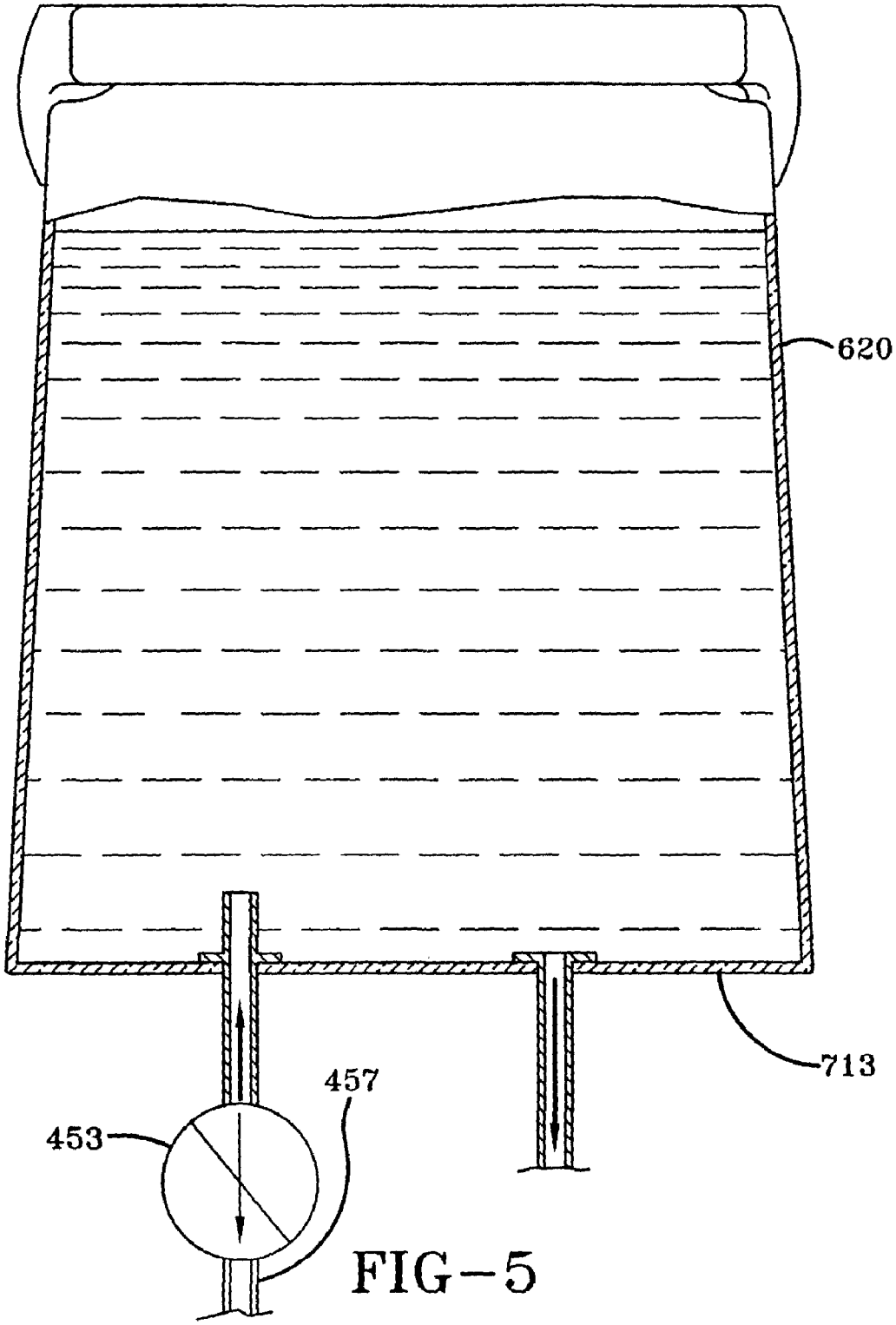
FIG. 5 is a vertical sectional view of the clean water tank of the carpet extractor of FIG. 1 showing still another embodiment of the present invention.

Referring to FIG. 5, in still another embodiment, a vent tube 457 is fluidly connected to the clean water tank 620 via the bottom wall 713. The lower end of the vent tube is opened to atmosphere. A check valve 453 is fluidly connected in the portion of the tube 457 outside the tank. The check valve 453 can be of any type, such as, for example, an umbrella type valve as that disclosed in U.S. Pat. No. 5,500,977, the disclosure of which is incorporated by reference, or a ball valve. The clean water tank 620 having this constant head device would be incorporated in the carpet extractor 60 of FIGS. 1 and 2. Also, this constant head device in the clean water tank 620 would also be used in the detergent tank 622. In operation, the check valve 453 opens to introduce air into the system near the bottom of the tank, as the liquid exits. However, the check valve 453 prevents water from exiting the tank through the vent tube 457. Thus, fluid flowing from each of the tanks does so under constant head pressure, which corresponds to the height between the outlet of the clean water tank 620 and the end of the vent tube 457 extending inside the clean water tank 620. This results in a constant flow of the liquid out of the clean water tank 620.

With continue reference to FIG. 2, the carpet extractor 60 includes a solution hose 794 that fluidly connects the outlet of the clean water tank 620 to a shut off valve 800 used for selectively turning on and off the flow of clean water. Another solution hose 790 fluidly connects the outlet of the water tank 620 to a first inlet 521 of a mixing Tee 797. A solution hose 798 fluidly connects the outlet of the detergent tank 622 to a second inlet 523 of the mixing Tee 797. The first outlet 525 of the mixing Tee 797 is fluidly connected to a first inlet 572 of a Tee 574 via a solution tube 823. The outlet of the Tee 574 is fluidly connected, via solution hose 876, to the second shut off valve 820 used for selectively turning on and off the flow of mixed water and detergent cleaning solution. Both shut off valves 800, 820 are fluidly connected to the distributor 792 through their respective solution hoses 794, 876. The shut off valves 800, 820 are in the form of solenoid valves, however, other types of valves also could be used.

The valves 800, 820 are operated by a trigger switch 821 as depicted in FIG. 1. The trigger switch 821 is pivotally connected to the upper handle portion 358 approximately near a closed looped handgrip 824. Slide switches 856, 858 are used to select one of the shut off valves 800, 822 to be opened and closed by the trigger switch 821. The water or detergent mixed with water cleaning solutions from the tanks 620, 622 flows by gravity to their associated shut off valves 800, 820. The cleaning liquid distributor 792 evenly distributes the cleaning liquid to each of the rotary scrub brushes 72. The scrub brushes 72 then spread the cleaning liquid onto the carpet (or bare floor), scrub the cleaning liquid into the carpet and dislodge embedded soil.

For above the floor cleaning, a solution hose 529 is fluidly connected between a second outlet 526 of the mixing Tee 797 and inlet to an air turbine driven pump 531. The outlet of the pump 531 is fluidly connected via a hose to a control valve or connector 877. The valve 877 includes a discharge nipple 218 positioned in an opening formed in the left side of the base assembly 64 as seen in FIG. 1. The pump pressurizes the cleaning solution drawing it to the control valve 877. The control valve 877 allows the cleaning solution to flow through a solution tube of an accessory tool and dispense by typical spray means. A quick disconnect coupling of the solution tube removably attaches to the discharge nipple 218. Further details of the quick disconnect coupling and air driven turbine pump is disclosed in U.S. Pat. No. 5,500,977, the disclosure of which is incorporated by reference.

Optionally, a second solution tube 584 fluidly connects to a third outlet 527 of the mixing Tee 797 and a second inlet 576 of the Tee 574 for transporting a second flow rate of cleaning liquid, that is greater than the flow rate through the solution tube 823, from the mixing Tee 797 to the distributor 792 and then to the carpet for cleaning heavily soiled areas. The diameter of this solution tube 584 is greater than that of the solution tube 823 to produce the larger flow rate. User operated valves 580, 582, provided in their respective solution tubes 823, 584, are selectively operated to obtain the desired flow rate. In particular, turning on the valve 580 associated with the solution tube 823 and turning off the valve 582 associated with the solution tube 584 results in a normal flow rate of cleaning liquid. Turning off the valve 580 associated with the solution tube 823 and turning on the valve 582 associated with the solution tube 584 results in a flow rate higher than normal flow rate of cleaning liquid. Alternatively, turning on both valves 580, 582 results in an even greater flow rate of cleaning solution than that through just one of the solution tubes 823, 584. The valves 580, 582 can be any suitable type such as, for example, a solenoid valve that is activated by a switch.

The cleaning liquid distributor 792 evenly distributes the cleaning solution to each of the rotary scrub brushes 72. The scrub brushes 72 then spread the cleaning solution onto the carpet (or bare floor), scrub the cleaning solution into the carpet and dislodge embedded soil. Such a distributor 792 and scrub brushes 72 are substantially disclosed in previously mentioned commonly owned U.S. Pat. No. 5,867,857, the disclosure of which is hereby incorporated herein as of reference.

As is commonly known, the carpet extractor 60 distributes the cleaning solution to the carpeted surface and substantially simultaneously extracts it along with the dirt on the carpet in a continuous operation. In particular, soiled cleaning liquid is extracted from the carpet by the suction nozzle 124 and transported into the recovery tank 80 where the liquid and air are separated. A vacuum is created in the recovery tank 80 by the motor fan assembly, which draws air from the recovery tank 80 and exhausts the air to the carpeted surface.

The present invention has been described by way of example using the illustrated embodiments. As previously mentioned, further details of the carpet extractor of the present invention are disclosed in co pending published application No. 2003/0226230; the disclosure being incorporated herein by reference. Upon reviewing the detailed description and the appended drawings, various modifications and variations of the embodiments will become apparent to one of ordinary skill in the art. All such obvious modifications and variations are intended to be included in the scope of the present invention and of the claims appended hereto. For example, the constant head device can be incorporated with cleaning machines with one supply tank such as those disclosed in U.S. Pat. No. 5,500,977, U.S. Pat. No. 5,983,442, or U.S. Pat. No. 6,842,942; the disclosures of these references are incorporated herein by reference.

In view of the above, it is intended that the present invention not be limited by the preceding disclosure of the embodiments, but rather be limited only by the appended claims.

What is claimed is:

1. A cleaning apparatus for cleaning a surface in which cleaning solution is dispensed to the surface and substantially simultaneously extracted along with the dirt on the surface in a continuous operation comprising:

a) a distributor for dispensing solution to said surface;

b) a first solution tank fluidly connected to said distributor for supplying a flow of solution to said distributor, said first solution tank having a bottom portion and an upper portion;

c) a recovery rank mounted to said cleaning apparatus;

d) a suction nozzle secured to said cleaning apparatus and in fluid communication with said recovery tank for transporting air and liquid into said recovery tank; and e) a first vent tube providing an air path communicating between an interior of said first solution tank and the atmosphere, said first vent tube extending down from said upper portion to a sufficient above said bottom portion such that, as a volume of solution is supplied to said distributor from said first solution tank air travels through said first vent tube from the atmosphere to the interior of the first solution tank to replace such volume, and the flow of solution from said first solution tank to said distributor is substantially constant independent of the level of solution in said first solution tank.

2. The cleaning apparatus of claim 1 including a second solution tank fluidly connected to said distributor for supplying a flow of solution to said distributor, said second solution tank having a bottom portion and an upper portion, a second vent tube providing an air path communicating between an interior of said second solution tank and the atmosphere, said second vent tube extending down from said upper portion to a sufficient distance above said bottom portion such that, as a volume of solution is supplied to said distributor from said second solution tank, air travels through said second vent tube from the atmosphere to the interior of the second solution tank to replace such volume, and the flow of solution from said second solution tank to said distributor is substantially constant independent of the level of the solution in said second solution tank.

3. The cleaning apparatus of claim 1 including a first conduit communicating said first solution tank with said distributor for transporting a first flow rate of cleaning liquid on said surface for normal cleaning, a second conduit communicating said first solution tank with said distributor for transporting a second flow rate of cleaning liquid, that is greater than said first flow rate, on said surface for cleaning heavily soiled areas, a valve system associated with said first conduit for selectively opening and closing said first conduit for selectively obtaining said first flow rate of cleaning liquid, and said valve system associated with said second conduit for selectively opening and closing said second conduit for selectively obtaining said second flow rate of cleaning solution.

4. The cleaning apparatus of claim 3 wherein said valve system includes a first valve associated with said first conduit for selectively opening and closing said first conduit for selectively obtaining said first flow rate of cleaning liquid, and a second valve associated with said second conduit for selectively opening and closing said second conduit for selectively obtaining said second flow raw of cleaning solution.

5. The cleaning apparatus of claim 3 including a second solution tank fluidly connected to said distributor for supplying a flow of solution to said distributor, said second solution tank having a bottom portion and an upper portion, a second vent tube providing an air path communicating between an interior of said second solution tank and the atmosphere, said second vent tube extending down from said upper portion to a sufficient distance above said bottom portion such that, as a volume of solution is supplied to said distributor from said second solution tank, air travels through said second vent tube from the atmosphere to the interior of the second solution tank to replace such volume, and the flow of solution from said second tank to said distributor is substantially constant independent of the level of the solution in said second solution tank.

6. The cleaning apparatus of claim 2 including a manifold having a first input fluidly connected to said first solution tank and a second input fluidly connected to said second solution tank, said manifold further having an outlet fluidly connected to said distributor.

7. The cleaning apparatus of claim 1 including a conduit connected between said first solution tank and said distributor, a fluid release valve positioned in said conduit, said fluid release valve being selectively opened to allow the solution to flow from said first solution tank to said distributor through said conduit, said fluid release valve being selectively closed to prevent the solution to flow from said first solution tank to said distributor through said conduit.

8. The cleaning apparatus of claim 7 wherein said fluid release valve includes a solenoid valve which is operated by a switch.

9. The cleaning apparatus of claim 1 including a brush assembly adapted to engage said surface.

10. The cleaning apparatus of claim 1 wherein said cleaning apparatus includes a base for movement along said surface and a handle pivotally connected to said base, said first solution tank being removably mounted to one of said base and said handle, said recovery tank being removably mounted to one of said base and said handle, said suction nozzle being associated with said base.

11. A cleaning apparatus for cleaning a surface comprising:

a) a distributor for dispensing solution to said surface;

b) a first solution tank fluidly connected to said distributor for supplying a flow of a first solution to said distributor, said solution tank having a bottom portion and an upper portion;

c) a first vent tube providing an air path communicating between an interior of said first solution tank and the atmosphere, said first vent tube extending down from said upper portion to a sufficient distance above said bottom portion such that, as a volume of solution is supplied to said distributor from said first solution tank, air travels through said first vent tube from the atmosphere to the interior of the first solution tank to replace such volume, and the flow of solution from said first solution tank to said distributor is substantially constant independent of the level of solution in said first solution tank;

d) a second solution tank fluidly connected to said distributor, said second solution tank having a bottom portion and an upper portion with an opening formed in said upper portion; and e) a second vent tube providing an air path communicating between an interior of said second solution tank and the atmosphere, said second vent tube extending down from said upper portion to a sufficient distance above said bottom portion such that, as a volume of solution is supplied to said distributor from said first solution tank air travels through said first vent tube from the atmosphere to the interior of the first solution tank to replace such volume, and the flow of solution from said second solution tank to said distributor is substantially constant independent of the level of solution in said second solution tank.

12. The cleaning apparatus of claim 11 including a first conduit communicating said first and second solution tanks with said distributor for transporting a first flow rate of cleaning liquid on said surface for normal cleaning, a second conduit communicating said first and second solution tanks with said distributor for transporting a second flow rate of cleaning liquid, that is greater than said first flow rate, on said surface for cleaning heavily sailed areas, a valve system associated with said first conduit for selectively opening and closing said first conduit for selectively obtaining said first flow rate of cleaning liquid, and said valve system associated with said second conduit for selectively opening and closing said second conduit for selectively obtaining said second flow rate of cleaning solution.

13. The cleaning apparatus of claim 11 including a manifold having a first input fluidly connected to said first solution tank and a second input fluidly connected to said second solution tank, said manifold further having an outlet fluidly connected to said distributor.

14. The cleaning apparatus of claim 11 including a conduit fluidly connected between said distributor and said first and second solution tanks, a fluid release valve positioned in said conduit, said fluid release valve being selectively opened to allow the solution to flow from said first and second solution tanks to said distributor through said conduit, said fluid release valve being selectively closed to prevent the solution to flow from said first and second solution tanks to said distributor through said conduit.

15. The cleaning apparatus of claim 14 wherein said fluid release valve includes a solenoid valve which is operated by a switch.

16. The cleaning apparatus of claim 11 including a brush assembly adapted to engage said surface.

17. A cleaning apparatus for cleaning a surface in which cleaning solution is dispensed to the surface and substantially simultaneously extracted along with the dirt on the surface in a continuous operation comprising:

a) a distributor for dispensing solution to said surface;

b) a solution tank fluidly connected to said distributor for supplying a flow of solution to said distributor, said solution tank having a bottom portion and an upper portion;

c) a recovery tank mounted to said cleaning apparatus;

d) a suction nozzle secured to said cleaning apparatus and in fluid communication with said recovery tank for transporting air and liquid into said recovery tank; and e) a first tubular member fluidly connected to said solution tank at said bottom portion; and f) a fluid flow device associated with said tubular member to maintain the flow of solution at a substantially constant rate independent of the level of solution in said solution tank, said fluid flow device including a second tubular member secured to said first tubular member, said first tubular member extending upwardly into said tank, said second tubular member defining an air reservoir having an upper portion and a lower portion, said air reservoir surrounding said first tubular, said upper portion of said air reservoir being in fluid communication with said first tubular member, said lower portion having a port positioned a sufficient distance above said bottom of said solution tank such that the flow of solution is substantially constant independent of the level of solution in said solution tank.

18. The cleaning apparatus of claim 17 wherein said port has a smaller cross-sectional area than that of said second tubular member.

19. A cleaning apparatus for cleaning a surface in which cleaning solution is dispensed to the surface and substantially simultaneously extracted along with the dirt on the surface in a continuous operation comprising:

a) a distributor for dispensing solution to said surface;

b) a solution tank fluidly connected to said distributor by a distributor tube for supplying a flow of solution to said distributor, said solution tank having a bottom portion and an upper portion;

c) a recovery tank mounted to said cleaning apparatus;

d) a suction nozzle secured to said cleaning apparatus and in fluid communication with said recovery tank for transporting air and liquid into said recovery tank; and e) a vent tube, separate and distinct from said distributor tube, fluidly connected to said solution tank at said bottom portion and communicating with the atmosphere; and f) a check valve disposed in said first tubular member between said solution tank and the atmosphere to maintain the flow of solution at a substantially constant rate independent of the level of solution in said solution tank.

* * * * *

UNITED STATES PATENT AND TRADEMARK OFFICE

CERTIFICATE OF CORRECTION

PATENT NO. : 7,954,200 B2
APPLICATION NO. : 10/396860
DATED : June 7, 2011
INVENTOR(S) : John A. Leonatti et al.

It is certified that error appears in the above-identified patent and that said Letters Patent is hereby corrected as shown below:

| | |
|---|---|
| Claim 1, Column 6, line 41: | Add the word --distance-- between the words "sufficient" and "above" |

Signed and Sealed this
Thirty-first Day of January, 2012

David J. Kappos

David J. Kappos
*Director of the United States Patent and Trademark Office*